United States Patent [19]

Wise

[11] 4,057,948

[45] Nov. 15, 1977

[54] LOCKING DEVICE

[76] Inventor: William D. Wise, Box 29, Genoa, Nev. 89411

[21] Appl. No.: 696,890

[22] Filed: June 17, 1976

[51] Int. Cl.[2] ..... E04C 1/10

[52] U.S. Cl. ..... 52/582; 52/265; 52/285; 52/584

[58] Field of Search ..... 52/594, 591, 592, 285, 52/286, 585, 587, 267, 583, 758 D, 265; 403/397

[56] References Cited

U.S. PATENT DOCUMENTS

| | | | |
|---|---|---|---|
| 2,140,772 | 12/1938 | Slayter | 52/753 G |
| 2,209,564 | 7/1940 | Grubb | 52/584 |
| 2,732,044 | 1/1956 | McClune | 52/584 |
| 3,310,919 | 3/1967 | Bue | 52/592 |
| 3,567,260 | 3/1971 | Norris | 52/584 |
| 3,742,672 | 7/1973 | Schaeufele | 52/594 |
| 3,798,860 | 3/1974 | Mason | 52/285 |

FOREIGN PATENT DOCUMENTS

| | | | |
|---|---|---|---|
| 704,409 | 4/1966 | Italy | 52/286 |

*Primary Examiner*—Price C. Faw, Jr.
*Assistant Examiner*—Henry Raduazo
*Attorney, Agent, or Firm*—Owen, Wickersham & Erickson

[57] ABSTRACT

A panel locking device for assembling and interlocking two double wall panels along their adjoining edges structurally integrates the locking device within the two panels and retains the panels tightly locked together under tension under all conditions of subsequent thermal expansion and contraction.

The locking device incorporates a locking pin which is driven through a lug and over a channel.

Each panel has a perimeter frame. One edge of the perimeter frame of one panel forms a male channel, and the adjoining edge of the perimeter frame of the other panel forms a female channel.

A lug is connected at one end to the web of the male channel. The outer end of the lug has a pin receiving and panel aligning hole extending through the lug.

The web of the female channel is formed with a lug receiving slot extending through the web.

An aligning and locking pin has a tapered tip; and when the panels are aligned edge-to-edge, the hole in the lug extends far enough above the backside of the female channel web to permit entry of the tapered tip of the pin. As the pin is driven into the hole and up to the full diameter of the pin, the lug is pulled upward through the slot in the female web. This produces elastic deflection of the male and female webs to retain the panels tightly locked together and structurally integrates the locking device into the perimeters of the two panels. The stressed deflection of the webs thus provides a constant and permanent force which urges the two panels together in tightly locked engagement.

5 Claims, 10 Drawing Figures

LOCKING DEVICE

BACKGROUND OF THE INVENTION

This invention relates to a panel locking device for assembling and interlocking two double walled structural panels to form apparently seamless walls, floors and roofs.

The invention relates particularly to a locking device which is structurally integrated within the panels when the panels are interlocked by the locking device.

A modular construction system for building walls, roofs and floors by connecting panels along adjoining edges has a number of advantages over conventional stick frame construction techniques. These advantages include greater economy, more precision in maintaining tolerances and considerably less time required for erecting buildings.

U.S. Pat. No. 3,543,462 issued Dec. 1, 1970 to Spratt et al; U.S. Pat. No. 3,608,258 issued Sept. 28, 1971 to Spratt; and U.S. Pat. No. 3,755,978 issued Sept. 4, 1973 to Jackson all relate to building constructions in which a plurality of double walled panels are serially interconnected at adjoining edges to form a wall, floor or roof.

While the modular panel systems disclosed in the above-mentioned patents have worked well, there has remained a need for a simple and easily installed locking device for locating, assembling and interlocking the double walled panels in a way different from and superior to the panel connectors disclosed in the above-noted patents.

SUMMARY OF THE INVENTION

It is a primary object of the present invention to interlock two double walled structural panels by a locking device which structurally integrates the locking device within the two panels.

The locking device contributes to the structural strength of the assembled panels by increasing both the pull strength and the shear strength. The locking device also increases the strength of each panel, at each location of a locking device, by a column effect.

Another important object of the present invention is to so construct the locking device that it can be used on site by unskilled labor.

The locking device of the present invention incorporates a locking pin which is driven through a lug and over a channel to produce an elastic deflection in web portions of the perimeter frames immediately adjacent the locking device. Drawing the panels together elastically keeps the panels locked tight together at all times to overcome any subsequent thermal expansion and contraction, and this is a further object of the present invention.

A relatively small number of locking devices can be spaced along a peripheral edge of a panel to contribute sufficient structural rigidity to prevent distortion by racking or twisting of the interlocked edges, and this constitutes a further specific object of the present invention.

The locking device of the present invention can be used to lock two adjoining panels together to form apparently seamless walls, floors and foor systems, or it can be used to lock a structural panel to another structural component, such as a building foundation or another wall.

In either case, the locking device includes a male shaped channel or receiver member and a female shaped channel member.

A lug is connected at one end to the web of the male shaped channel, or to the flat strip of the male shaped receiver member; and the outer end of the lug has a pin receiving and panel aligning hole extending through that outer end.

The web of the female shaped channel member is formed with a lug receiving slot extending through the web.

Guide means are associated with the outer edges of the flanges of the female shaped member and corresponding structure on the male shaped channel or receiver member. Thus, as the panel with the female shaped member is aligned in edge contact with a panel with the male shaped channel (or with some other structural component to which a male shaped receiver member is attached), the outer end of the lug projects through the slot in the web of the female shaped channel member.

At this point in the assembly, the pin receiving hole in the lug extends far enough above the back side of the female channel web to permit initial entry of the tapered tip of an aligning and locking pin. However, any further movement of the pin into the hole requires pulling of the lug through the slot to cause elastic deflection of the webs of the locking device. The locking pin is then driven fully into the hole in the lug, along the backside of the female channel web, up to the full diameter of the locking and aligning pin. This draws the panels together elastically and retains the panels interlocked under the stress produced by the elastic deflection of the webs.

In specific embodiments of the present invention the panels which incorporate the locking devices of the present invention are double walled structural panels of a sandwich type construction.

Each panel has a perimeter or frame (which may be of aluminum, steel or plastic), a pair of outer walls or skin surfaces, and a core which is laminated or bonded to the outer walls or skin surfaces to form a structural component.

Each component of the sandwiched panel contributes to the structural strength, and a wide variety of materials can be used for the different components. For example, as noted above, the perimeter frame can be a metal or a plastic. The exterior skin can be a wood exterior, wall board or a plastic such as polyvinyl chloride. The inner core can be a foam, such as polyurethane foam, or in some cases it can be a concrete inner core. The particular material for the core is determined, in many cases, by the primary function to be provided by the core—whether structural, acoustic or thermally insulating.

The size and proportions of the panel can also vary, depending upon the application.

The amount of tension produced by the locking device is determined by the thickness of the webs which are deflected and also by the total number of locking devices and the spacing between the locking devices associated with an edge of a panel. For example, in some embodiments of the invention the locking devices are used on twenty-four inch centers (as compared to the normal sixteen inch centers of conventional two-by-fours). In other instances the locking devices are connected on thirty inch or forty inch centers. The extended connection on twenty-four inch (or greater) centers is possible because of the combination of the laminated sandwich panel with the metal or plastic perimeter and the strength contributed by the locking device in the present invention.

In certain applications the panel may not have any core material. For example, a core is not used when the panel is intended only as a shield or back drop. In other cases some or all of the interior space in the panel may be left open for wiring, pipes, etc.

In all cases the locking device of the present invention is located on the perimeter of the panel and is used to lock the panel to an associated panel or to some other structural component of the building.

The peripheral panel interlock of the present invention thus permits easy assembly of the panels at a construction site without the need for skilled labor and also provides a locking device which combines with the panel walls, perimeter and inner core to form interconnected panel walls, roof and floor structures of high strength and rigidity and without any preexisting reinforcing structure such as two-by-fours and the like.

Locking device apparatus and methods which incorporate the structures and techniques described above and which are effective to function as described above constitute specific objects of the invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 1 also shows the orientation of FIGS. 7 and 8 which illustrate details of the locking devices incorporated in interconnected wall, roof and floor panels.

FIG. 4 shows the two edges of the panel just before they are engaged. FIG. 5 shows the two edges of the panels after the guide means of the locking device have been engaged and with the tapered end of the locking pin inserted through the hole in the lug just prior to driving the full diameter of the locking pin into the hole. FIG. 7 shows the locking pin fully driven into the hole in the lug to pull the lug upward in the slot to produce the elastic deflection of the male and female channel webs which retains the panels tightly locked together.

In FIG. 6 the pin has not been shown, and the sides of the panels have been partly broken away to show the relative position of the hole in the tongue with respect to the back surface of the female channel web just prior to inserting the tapered end of the pin into the lug hole.

FIG. 8 is taken along the line and in the direction indicated by the arrows 8—8 in FIG. 1.

FIGS. 7 and 8 are taken along the lines and in the directions indicated by the arrows 7—7 and 8—8 in FIG. 1.

DESCRIPTION OF THE PREFERRED EMBODIMENTS

Figure 1:
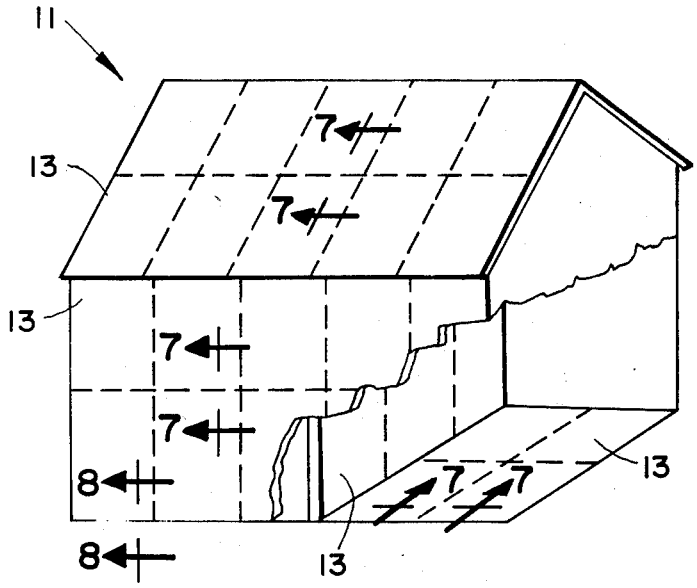
FIG. 1 is an isometric view of a building showing how a series of interconnected panels (indicated by the dashed outlines) are incorporated in the walls, floor and roof of the building.

FIG. 1 shows a building, indicated generally by the reference numeral 11, constructed with modular structural panels 13 in the roof, outer walls, floor and inner walls. The modular panels are interlocked together by peripheral locking devices 30 shown in FIGS. 3 and 4–8 and described in more detail below.

Figure 2:
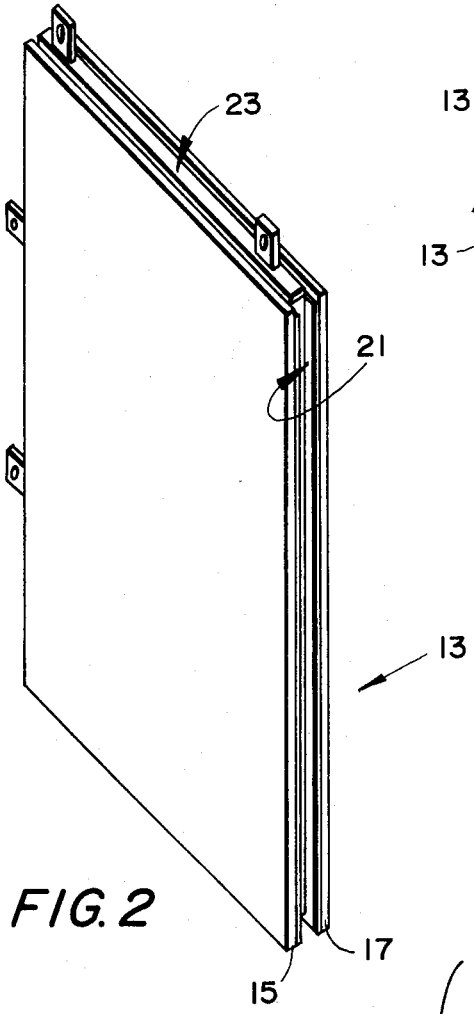
FIG. 2 is an isometric view of a modular structural panel which incorporates peripheral locking devices constructed in accordance with embodiments of the present invention. The panel shown in FIG. 2 can be used as a wall, floor or ceiling panel in the building shown in FIG. 1.

A typical structural panel 13, as used in the walls, roof and floor of the building 11, is shown in more detail in FIG. 2.

Figure 4:
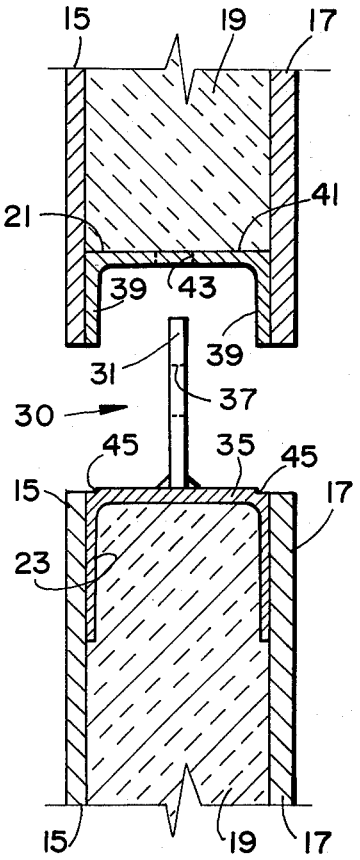
FIGS. 4, 5 and 7 are fragmentary cross-sectional, end elevation views showing the sequence of aligning and locking two structural panels with a locking device constructed in accordance with one embodiment of the present invention.

The panel 13 is a sandwiched panel and has two outer walls or surface coverings 15 and 17 which are bonded or laminated to a core 19 (see FIG. 4). This sandwiched construction makes the panel a structural panel.

The panel 13 also comprises a perimeter frame.

The perimeter frame, in the specific embodiment of the panel 13 shown in FIG. 2, comprises a female channel 21 (which extends along the right hand edge of the panel 13 and along the lower edge of the panel 13 shown in FIG. 2) and a male channel 23 (which extends along the left hand edge and also on the upper edge of the panel 13 shown in FIG. 2).

The perimeter frame 21, 23 is formed from steel, aluminum or plastic.

The outer walls or coverings 15 and 17 may be wood, wall board, plastic, or some other material, depending upon the application.

The material of the inner core will also vary, depending upon the application. For example, the core material may be foam, such as polyurethane foam, or in some cases it may be concrete, depending upon the structural, acoustical and insulating properties required for the particular panel.

Also, while the panel 13 shown in FIG. 2 is shown as a rectangular panel of an approximate standard four foot by eight foot configuration, the size and particular dimensions can vary, again depending upon the job for which the panel is intended.

In a specific embodiment of the invention the panels are made by welding the perimeter frame, attaching the outer coverings and then foaming the core while the frame and outer coverings are retained in place under pressure until the core sets up. This produces a high strength, laminated structure panel.

As can be readily seen from FIG. 1, a number of panels 13 are serially interconnected along their adjoining edges to form a complete wall or floor or roof of the building and without auxiliary framing such as conventional two-by-fours.

Because the panel 13 is a laminated, sandwiched construction in which the inner core is actually laminated to the exterior walls or skins 15 and 17 and to the perimeter 21, 23, the panel 13 provides substantial structural strength, even when the outer coverings 15 and 17 are relatively thin coverings.

In accordance with the present invention a locking device indicated generally by the reference numeral 30 in FIGS. 3–8, is associated with each panel 13 to assemble and to interlock the panels along the adjoining edges of the panels while structurally integrating the locking device within the two panels.

Figure 8:
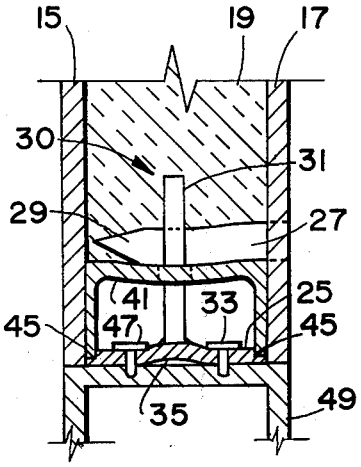
FIG. 8 is an end elevation view in cross section, generally like FIG. 7, but illustrating how the locking device of the present invention is used to connect a panel to a building foundation or to a stud wall.

The locking device 30 comprises the female shaped channel 21 and the male shaped channel 23 (or a corresponding male shaped receiver 25 shown in FIG. 8 when the male shaped element of the locking device 30 is associated with a building foundation or a stud wall rather than with another panel).

Figure 3:
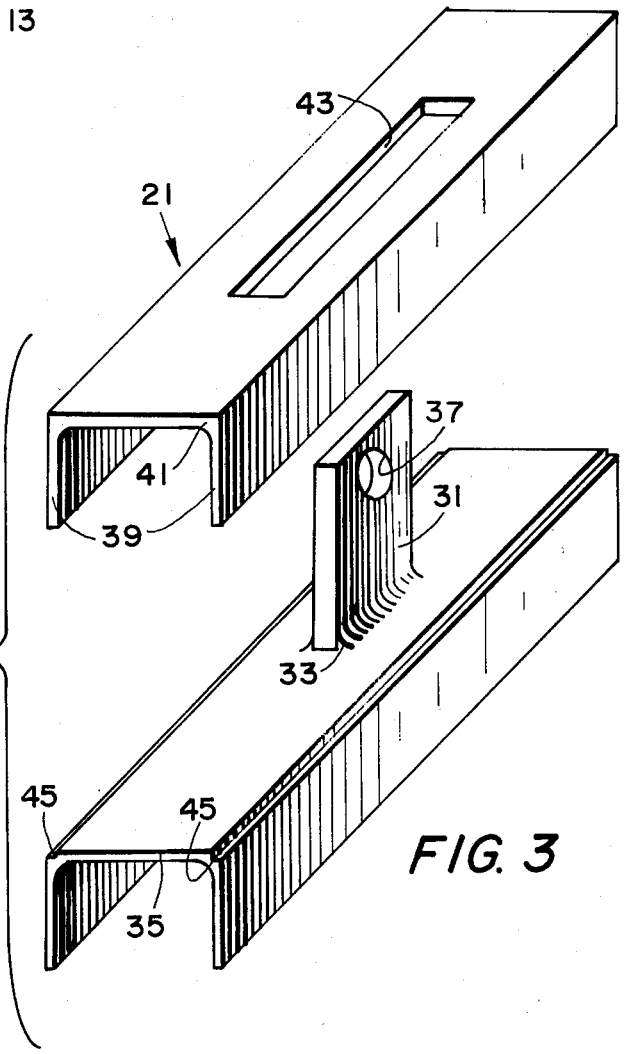
FIG. 3 is an exploded isometric view showing details of the female shaped channel and the male shaped channel or receiver member of a locking device constructed in accordance with the present invention. The female channel shown in FIG. 3 extends along the right peripheral edge of the panel shown in FIG. 2, and the male shaped channel shown in FIG. 3 extends along the left peripheral edge of the panel shown in FIG. 2.
Figure 6:
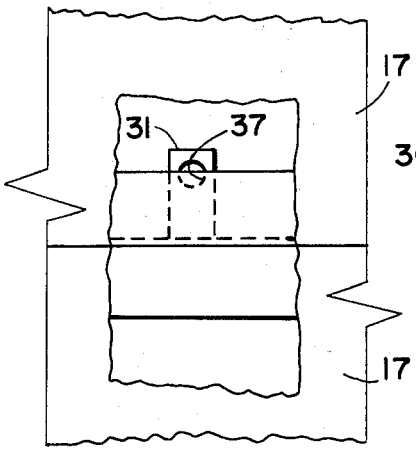
FIG. 6 is a fragmentary side elevation view, taken along the line and in the direction indicated by the arrows 6—6 in FIG. 5.
Figure 5:
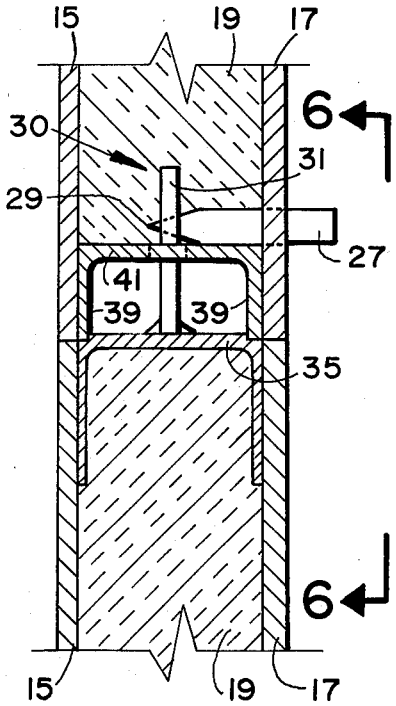
Figure 7:
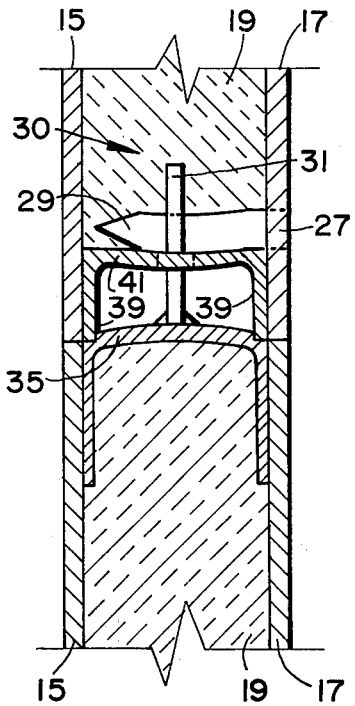

The locking device 30 also includes an aligning and locking pin 27 (not shown in FIG. 3 but illustrated in FIGS. 5, 7 and 8). The pin 27 has a tapered end 29.

The locking device 30 also includes a lug 31 which is connected, as by welding 33, at one end to a web 35 of the male shaped channel 23 (or to the corresponding flat strip 35 of the receiver member 25 shown in FIG. 8).

The outer end of the lug 31 is formed with a pin receiving and panel aligning hole 37.

The female channel 21 includes side flanges 39 and a web 41.

A lug receiving slot 43 is formed in the web 41.

As best illustrated in FIGS. 3 and 8, both the male shaped channel 23 and the male shaped receiver 25 have corner grooves 45 which coact with the lower ends of the female flanges 39 to act as guide means for insuring correct initial alignment of two adjoining panels 13.

The receiver member 25 has similar grooves 45 which serve as guide means for insuring correct alignment of the panel 13 with respect to the structural component to which the receiver 25 is connected. In FIG. 8 the receiver 25 is shown connected by screws 47 to a box beam 49 which is in turn connected to a building foundation (not shown in the drawings).

As also illustrated in FIGS. 4, 5, 7 and 8 the outer walls or coverings 15 and 17 are so attached to the perimeter frames 21 and 23 as to form an apparently seamless connection when the panels are assembled.

In the operation of the locking device 30, adjoining panels are brought together in edge alignment as illustrated in FIGS. 4 and 5; and the pin 27 is then driven through the side wall of one panel and along the back surface of the web 41 of the female channel. As this pin 27 is driven through the side wall of the panel, the tapered end 29 of the pin enters the part of the hole 37 which extends above the web 41 until the taper on the pin engages the inner periphery of the hole. Continued driving of the pin 27 through the panel then pulls the lug 31 upward through the slot 43 producing elastic deflection of the male web 35 and also some elastic deflection of the female web 41 as illustrated in FIG. 7.

The same elastic deflection occurs in the web or strip 35 of the receiver 25 shown in FIG. 8.

The two panels are thereafter retained tightly locked together under tension under all conditions of subsequent thermal expansion and contraction, and the locking device 30 is structurally integrated within the two interlocked panels.

The amount of force with which the two panels are held together under tension is determined in part by the thickness of the webs 35 and 41 and also by the relative diameter of the pin 27 and location of the hole 37 in the lug 31.

The connection provided by the locking device 30 is intended to be a relatively permanent connection; however, the pin 27 can be driven out of the hole 37 for disassembling of the panels if desired.

Since the elastic deflection of the webs 35 and 41 represents a continuing stress, the locking device 30 not only retains the panels tightly locked together to prevent subsequent loss of tolerance by thermal expansion and contraction, but the locking device also increases the pull strength and shear strength of the interlocked panels in the vicinity of the locking device.

The locking device 30 also provides a column effect because of the interlocked engagement of the side flanges 39 of the female channel with the web 35 of the male channel, as can be best seen from FIG. 7. This box section joint provides high flexural strength, both vertically in side walls and horizontally in floors.

The space within the column or box section formed by the interlocked male and female channels can be filled with acoustic or insulating material if desired.

The locking devices 30 of the present invention, in a particular embodiment of the present invention, have been located at a minimum of twenty-four inch centers (as compared to the normal sixteen inch center for two-by-fours), and in certain applications, location at 4/8 inch centers with conventional four-by-eight panels has proved quite satisfactory.

Figure 9:
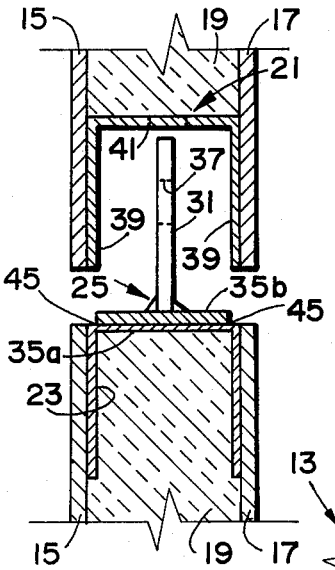
FIG. 9 is a fragmentary, cross sectional, end elevation view like FIG. 4, but showing an alternate embodiment in which a flat bar is used in combination with a male channel to establish corner grooves for guiding the flanges of a female channel into place.

FIG. 9 is a fragmentary, cross sectional, end elevation view like FIG. 4, but shows an alternate embodiment in which a flat bar is used in combination with the male channel to establish the corner grooves for guiding the flanges of the female channel into place.

When steel channels are used for the perimeter frame, the construction shown in FIG. 9 is a preferred way to provide the corner grooves 45 since this construction does not require extrusion. Instead, the receiver 25 has a width, without corner grooves, which is just slightly less than the interior dimension between the inside surfaces of the flanges 39 of the female channel; and the side edges of the receiver 25 serve as guide means 45 for guiding the female channel 21 into place.

In this construction the web 35A of the male channel 23 is connected to the receiver 25, by welding, screws or other suitable means, so that the interconnected cross section 35B of the receiver and the web 35A serve as the elastically deflectable web of the male perimeter member.

Figure 10:
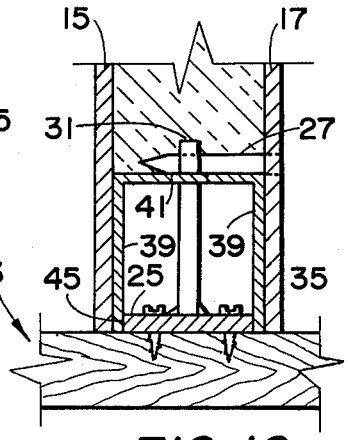
FIG. 10 is an end elevation view in cross section like FIG. 8, but showing an alternate embodiment in which a flat bar receiver member is attached to a floor or to an inner surface of a wall panel and the flanges of the female channel come to a stop at the surface of the floor or wall.

FIG. 10 is an end elevation view in cross section like FIG. 8 but shows an alternate embodiment in which a flat bar receiver member 25 is attached to a floor or to an inner surface of a wall panel. In this embodiment the flanges 39 of the female channel come to a stop at the surface of the floor or wall.

In the FIG. 10 embodiment the side edges 45 of the flat bar 35 can serve as guide means for the flanges 39. In many cases the flat bar 35 can be made somewhat narrower, because the alignment of the panel 13 (shown in cross section in FIG. 10) along the surface of the floor or wall often is not as critical as is the edge alignment of the two panels shown in FIG. 9.

In the FIG. 10 construction no step or corner groove in the outer edges of the male receiver member 25 is required because the panel (the vertical panel shown in FIG. 10) attached to the male receiver member 25 comes to a stop at the surface of the floor or wall panel (the horizontal panel shown in FIG. 10) on which the male receiver member 25 is mounted.

FIG. 10 does not show a deflection of the web 41 of the female channel or web 35 of the male receiver member 25 (which deflection is exaggerated in FIGS. 7 and 8 for purposes of illustration) but the locking pin 27 of the FIG. 10 embodiment does produce the same elastic deflection (when the pin is driven through the lug and over the web 41 of the female channel) to provide the same positive retaining force as described above in relation to the other embodiments of the present invention.

While I have illustrated and described the preferred embodiments of my invention, it is to be understood that these are capable of variation and modification and I therefore do not wish to be limited to the precise details sets forth, but desire to avail myself of such changes and alterations as fall within the purview of the following claims.

I claim:

1. A panel locking device for assembling and interlocking two double walled, bonded core, structural panels of the kind which exhibit a substantial amount of thermal expansion and contraction in normal installed use and wherein said locking device provides the interlocking along the adjoining edges of the panels by structurally integrating the locking device within the two panels, said locking device comprising, a first panel comprising two spaced outer covers an inner core bonded to the outer covers, and a perimeter frame means a second panel comprising two spaced outer covers an inner core bonded to the outer covers, and a perimeter frame means, said first perimeter frame means comprising a first relatively rigid but elastically deflectable male web and a lug connected to the web at one end of the lug and having an outwardly projecting end with a pin receiving and panel aligning hole extending through the outer end of the lug, said second perimeter means comprising a female channel having two flanges and a second relatively rigid but elastically deflectable web between the flanges and formed with a lug receiving slot extending through the web, an aligning and locking pin having a tapered tip, and wherein a pair of the pin receiving hole in the lug is so located as to permit initial entry of the tapered tip of the pin into the pin receiving hole along the backside of the female web when the two panels are aligned in initial edge contact with the edges of the female channel flanges engaged with the male web and with the lug extending through the slot in the web of the female channel and wherein the pin receiving hole is also so located so as to require sufficient elastic deflection of the male and female webs as to retain the panels tightly locked together under tension under all conditions of subsequent thermal expansion and contraction of the bonded cores and structural panels when the pin is driven into the hole up to the full diameter of the pin.

2. The invention defined in claim 1 wherein a plurality of said locking devices are located along the adjoining edges of the first and second panels and the locking devices contribute to the structural strength of the assembled panels by both the pull strength and the sheer strength exhibited by the locking devices in association with the perimeter frames of the panels and wherein the locking devices increase the strength of each panel at each location of a locking device by a column effect.

3. A locking device for connecting the edge of a double walled structural panel of the kind having two outer covers bonded to an inner core and of the kind which can undergo a substantial amount of thermal expansion and contraction in normal installed use to another structural component, such as a building foundation or another panel or wall, and comprising, a male receiver member connected to said structural component and having a deflectable web facing outward, an outwardly projecting lug attached to the deflectable web at one end of the lug and having an outwardly projecting end with a pin receiving and a panel aligning hole extending through the outer end of the lug, a structural panel comprising two spaced outer covers, an inner core bonded to the outer covers, and a perimeter frame, said frame including, a female channel member positioned in the edge of the panel and having a web spaced inwardly from the edge, said web including at least one slot positioned opposite the lug of the male receiver member with the lug passing through the slot, and a pin extending through the lug opening and exerting a pulling force on the lug toward the panel, the pin being braced against the back surface of the female web, and wherein at least the male web is elastically deflected outward in the vicinity of the lug so that the panel is continuously urged toward the other structural component under tension to prevent any subsequent separation and loss of tolerance between the structural panel and the other structural component due to thermal expansion and contraction of the bonded inner core of the structural panel.

4. The invention defined in claim 5 wherein the female channel member has a pair of flanges extending outwardly and into seated engagement with the male receiver member web.

5. A modular construction system for forming a planar structure with apparent seamless connections between adjoining structural panels which exhibit a substantial amount of thermal expansion and contraction in normal installed use and comprising, a plurality of rectangular shaped structural panels, each panel comprising two spaced outer covers, an inner core bonded to the outer covers, and a perimeter frame, each perimeter frame having one edge formed with a male channel interlock member and a second edge formed with a female channel interlock member, said male channel interlock member comprising a U-shaped channel connected to the outer covers and having a deflectable web, said deflectable web including at least one outwardly extending lug with a pin receiving opening in the outer end of the lug, said female channel interlock member comprising a U-shaped channel connected to the outer covers and having a deflectable web, said female web including at least one slot at a location corresponding to that of a tongue of an adjacent panel, guide means associated with the male and female channel members for seating the male and female channel members of adjacent panels in edge-to-edge relationship, an aligning and locking pin having a tapered tip, and wherein the pin receiving opening of the lug is so located with respect to the web of the female channel as to deflect the male and female webs to a condition where the deflected webs retain their supporting tension to overcome subsequent thermal expansion and contraction of the bonded inner core and the structural panels and to keep the unit locked tight at all times when the pin has been driven along the backside of the female channel web and through the pin aligning opening in the lug past the tapered tip of the pin and up to the full diameter of the pin.

* * * * *